US009607590B1

(12) United States Patent
Liao

(10) Patent No.: US 9,607,590 B1
(45) Date of Patent: Mar. 28, 2017

(54) DRUM COUNTERHOOP CLAMPING DEVICE

(71) Applicant: Tsun-Chi Liao, Taichung (TW)

(72) Inventor: Tsun-Chi Liao, Taichung (TW)

( * ) Notice: Subject to any disclaimer, the term of this patent is extended or adjusted under 35 U.S.C. 154(b) by 0 days.

(21) Appl. No.: 14/973,173

(22) Filed: Dec. 17, 2015

(51) Int. Cl.
*G10D 13/02* (2006.01)

(52) U.S. Cl.
CPC ..... *G10D 13/026* (2013.01)

(58) Field of Classification Search
CPC ..... G10D 9/04
USPC ..... 84/421
See application file for complete search history.

(56) References Cited

U.S. PATENT DOCUMENTS 5,877,440 A * 3/1999 Chaffee ..... G10D 13/022 84/411 M
6,344,605 B1 * 2/2002 Liao ..... F16M 11/10 84/327
2014/0123831 A1 * 5/2014 Dunnett ..... G10D 13/026 84/411 R
2016/0157003 A1 * 6/2016 Krol ..... F16M 13/022 248/229.22

* cited by examiner

*Primary Examiner* — Jianchun Qin
(74) *Attorney, Agent, or Firm* — Muncy, Geissler, Olds & Lowe, P.C.

(57) ABSTRACT

A drum counterhoop clamping device, which is to be fixed to a drum counterhoop, comprises a base, a clamping block and a locking member. The base includes a sliding chute and a first clamping plate extending outward and vertically to the sliding chute. The clamping block includes a sliding post slidably installed inside the sliding chute and a second clamping plate extending outward and vertically to the sliding post. The first clamping plate and the second clamping plate are disposed corresponding to each other. The locking member drives the base and the clamping block to approach to each other and enforces the sliding post to pass through the sliding chute to decrease the distance between the first clamping plate and the second clamping plate. Thereby, the present invention uses the plane-like first clamping plate and second clamping plate to increase stability and strength of clamping the drum counterhoop.

8 Claims, 8 Drawing Sheets

DRUM COUNTERHOOP CLAMPING DEVICE

FIELD OF THE INVENTION

The present invention relates to a clamping device for a musical instrument, particularly to a drum counterhoop clamping device.

BACKGROUND OF THE INVENTION

Refer to FIG. 1 and FIG. 2. A conventional drum counterhoop clamping device 1 is clamped to a drum counterhoop 2 for fixing various musical instruments or auxiliary instruments to the drum counterhoop 2. As shown in FIG. 2, a cymbal 3 is installed at the conventional drum counterhoop clamping device 1 and thus fixed to the drum counterhoop 2.

The conventional drum counterhoop clamping device 1 comprises a baseplate 4, a clamping plate 5 pivotally coupled to the baseplate 4, a fixing plate 6 extended laterally from the baseplate 4 and disposed opposite to the clamping plate 5, an adjusting screw 7 inserted through one end of the clamping plate 5 and screwed into the baseplate 4, and a spring 8 sleeving the adjusting screw 7 and disposed between the baseplate 4 and the clamping plate 5. The adjusting screw 7 is screwed to rotate the clamping plate 5 toward the baseplate 4 and narrow the gap between the clamping plate 5 and the fixing plate 6, whereby conventional drum counterhoop clamping device 1 is fastened to the drum counterhoop 2. The resilience force of the spring 8 can shore up the baseplate 4 and the clamping plate 5 and automatically sustain the gap between the clamping plate 5 and fixing plate 6, whereby the conventional drum counterhoop clamping device 1 can be unlocked from the drum counterhoop 2 conveniently.

However, it is not horizontally that the clamping plate 6 moves relatively to the fixing plate 6 in the conventional drum counterhoop clamping device 1. Thus, the side force may cause the conventional drum counterhoop clamping device 1 to slip off. In order to prevent the conventional drum counterhoop clamping device 1 from slipping off, clamping arc grooves 9 are formed on the opposite sides of the clamping plate 5 and the fixing plate 6 to grasp the drum counterhoop 2. Nevertheless, the clamping arc grooves 9 do not always grasp the drum counterhoop 2 exactly, and the conventional drum counterhoop clamping device 1 still has likeliness to slip off. Apparently, the conventional drum counterhoop clamping device 1 is inferior in stability and strength and unable to meet requirement of users.

SUMMARY OF THE INVENTION

The primary objective of the present invention is to provide a drum counterhoop clamping device able to clamp a drum counterhoop stably.

In order to achieve the abovementioned objective, the present invention proposes a drum counterhoop clamping device, which is to be fixed to a drum counterhoop and comprises a base, a clamping block and a locking member. The base includes a sliding chute and a first clamping plate extending outward and vertically to the sliding chute. The clamping block includes a sliding post slidably installed inside the sliding chute and a second clamping plate extending outward and vertically to the sliding post. The first clamping plate and the second clamping plate are disposed corresponding to each other. The locking member drives the base and the clamping block to approach to each other and enforce the sliding post to pass through the sliding chute so as to decrease the distance between the first clamping plate and the second clamping plate.

In the present invention, the locking member is rotated to decrease the distance between the first clamping plate and the second plating. As the first clamping plate and the second clamping plate are displaced relatively in a horizontal direction, side force would not appear. Thereby, the first clamping plate and the second clamping plate can grip two sides of the drum counterhoop stably. Therefore, the present invention can clamp a drum counterhoop stably with high strength and satisfy requirement of users.

DETAILED DESCRIPTION OF THE PREFERRED EMBODIMENTS

Below, embodiments are described in detail in cooperation with drawings to fully demonstrate the technical contents, characteristics, and efficacies of the present invention.

Figure 1:
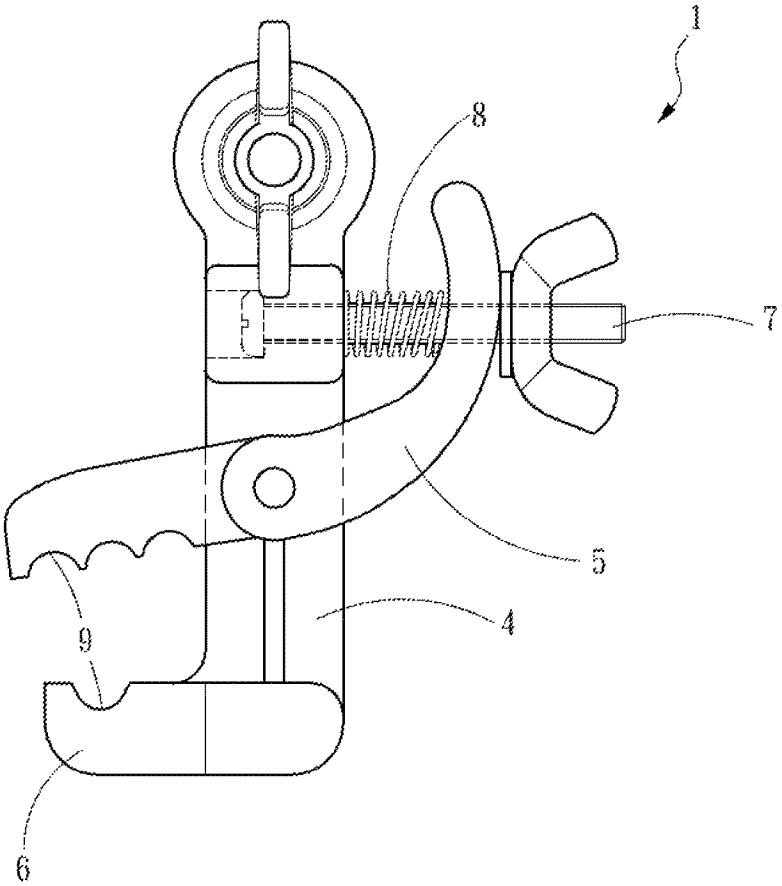
Fig. 1 PRIOR ART
FIG. 1 is a diagram schematically showing the structure of a conventional drum counterhoop clamping device.
Figure 2:
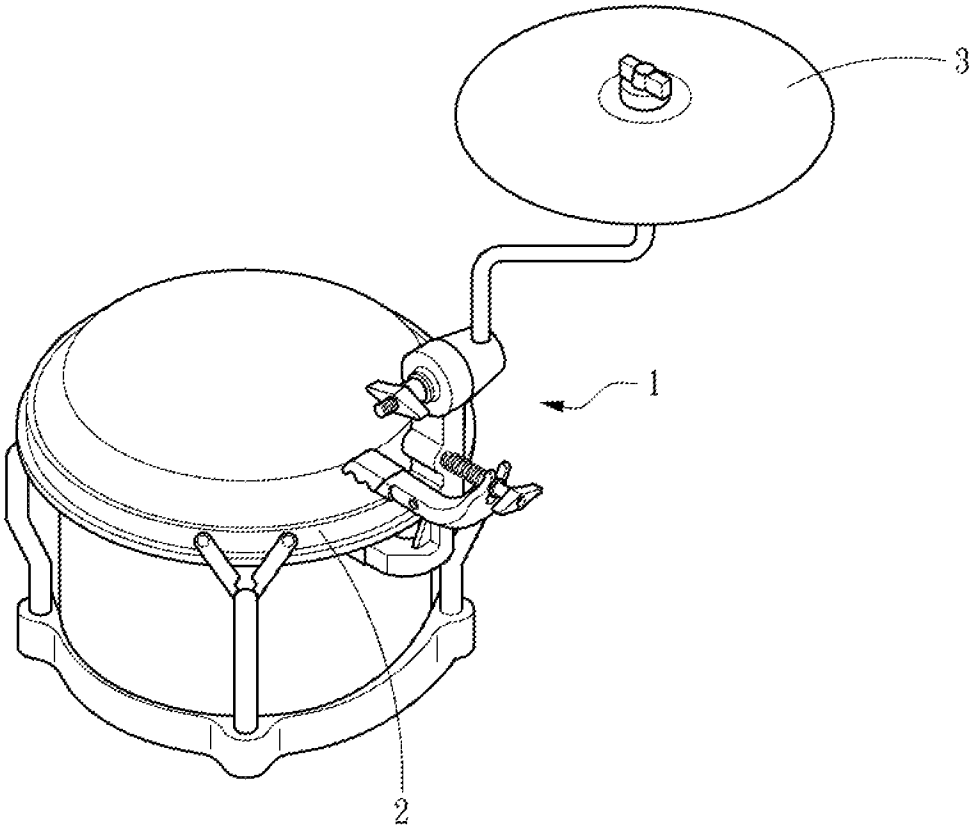
Fig. 2 PRIOR ART
FIG. 2 is a diagram schematically showing the usage of a conventional drum counterhoop clamping device.
Figure 3:
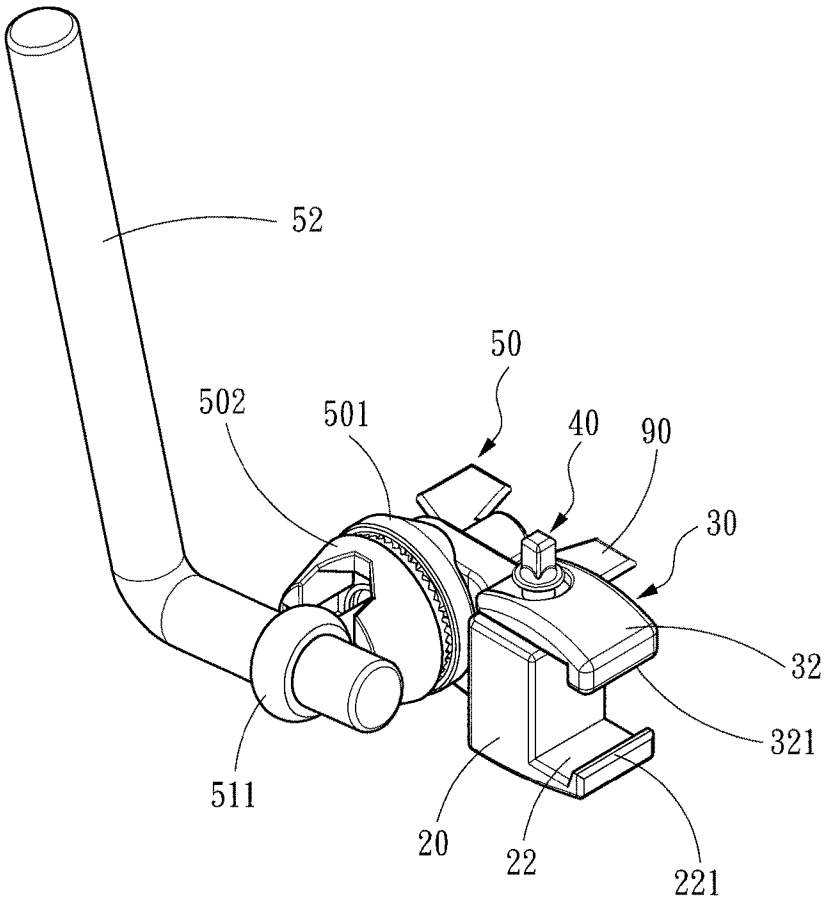
FIG. 3 is an assembled view schematically showing a drum counterhoop clamping device according to one embodiment of the present invention.
Figure 4:
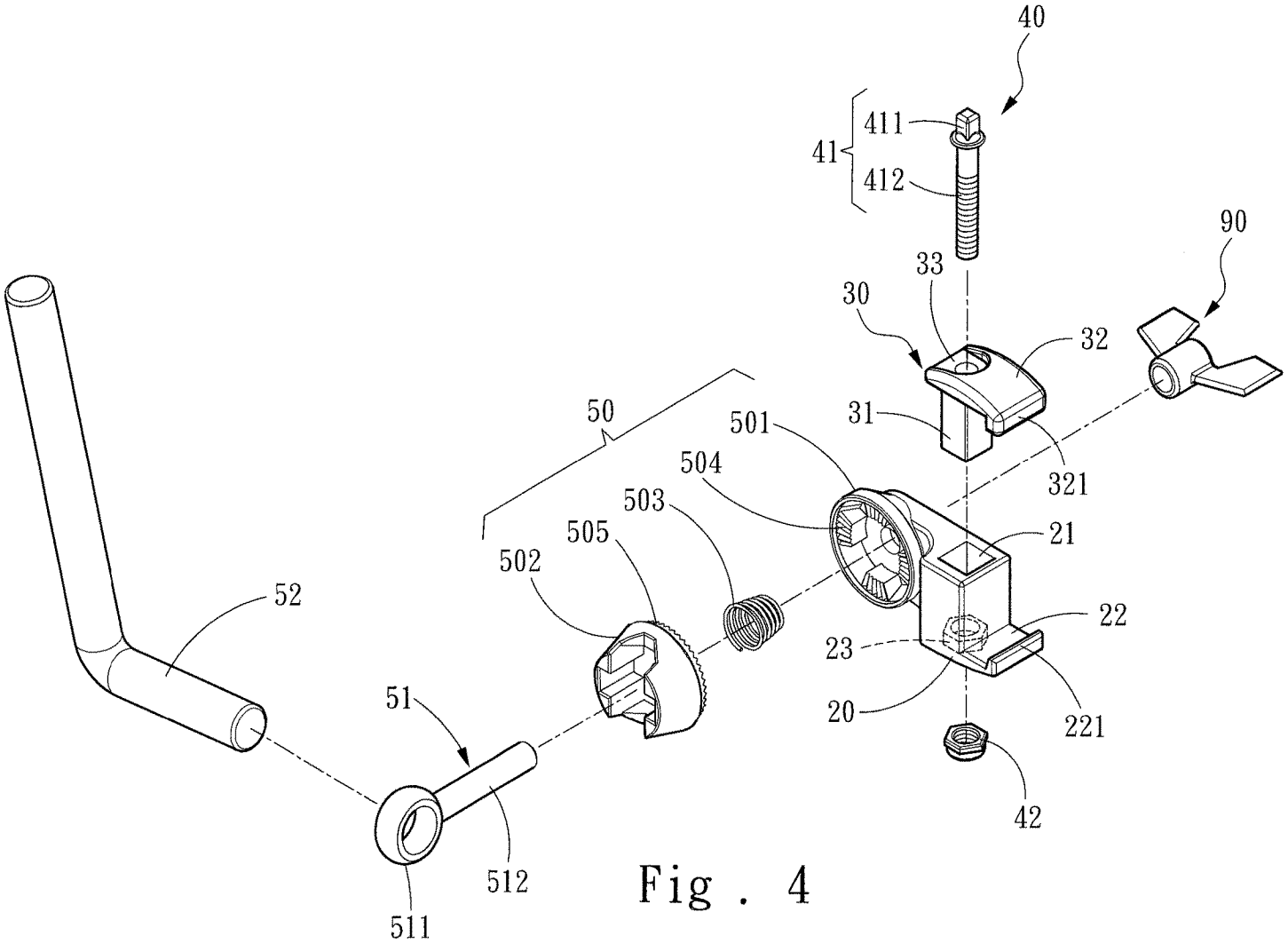
FIG. 4 is an exploded view schematically showing a drum counterhoop clamping device according to one embodiment of the present invention.

Refer to FIG. 3 and FIG. 4. The present invention discloses a drum counterhoop clamping device, which is to be fixed to a drum counterhoop 10 and comprises a base 20, a clamping block 30 and a locking member 40. The base 20 includes a sliding chute 21 and a first clamping plate 22 extending outward and vertically to the sliding chute 21. The clamping block 30 includes a sliding post 31 slidably installed inside the sliding chute 21 and a second clamping plate 32 extending outward and vertically to the sliding post 31. The first clamping plate 22 and the second clamping plate 32 are disposed corresponding to each other. A first flange 221 and a second flange 321 are respectively extended from the first clamping plate 22 and the second clamping plate 32 to form hooking structures, which can enhance the stability of clamping the drum counterhoop 10.

The locking member 40 is driven to enforce the sliding post 31 to pass through the sliding chute 21 and decrease the distance between the first clamping plate 22 and the second clamping plate 32, whereby the base 20 and the clamping block 30 approach to each other and hold the drum counterhoop 10 therebetween. Then, the first clamping plate 22 and the second clamping plate 32 can be displaced parallel to clamp the drum counterhoop 10.

In one embodiment, the locking member 40 includes a screw 41 and a nut 42, which can be screwed together. The screw 41 includes a screw head 411 and a screw body 412. In operation, the screw body 412 is passed through the sliding post 31 with the screw head 411 pressed against the sliding post 31; the nut 42 is pressed against the sliding chute 21; the screw 41 is rotated to enable the screw head 411 to push the sliding post 31 into the sliding chute 21. For convenience and appearance, the clamping block 30 includes a recess 33 for accommodating the screw head 411, and the base 20 includes an embedding cavity 23 for accommodating the nut 42 and restraining rotation of the nut 42.

Figure 5:
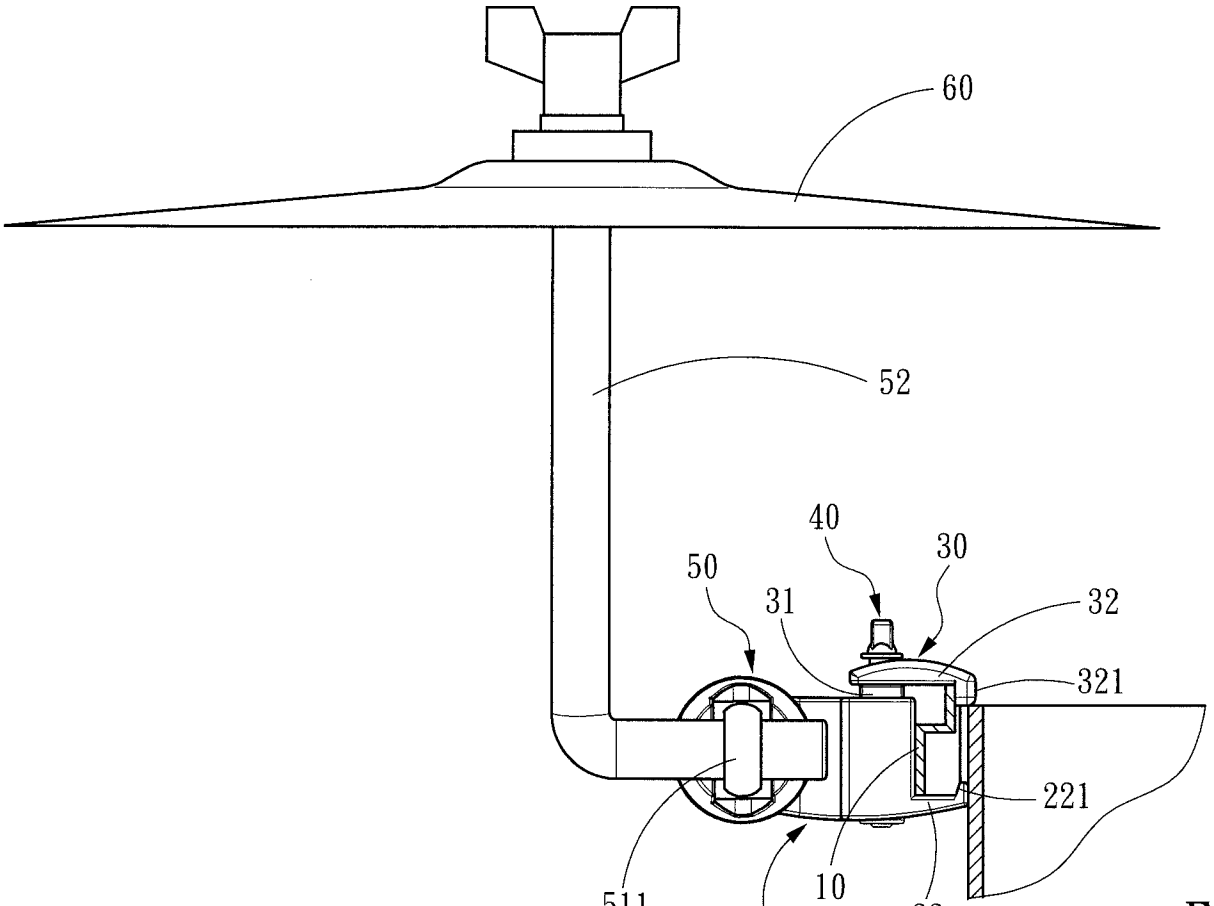
FIG. 5 is a diagram schematically showing an application of a drum counterhoop clamping device according to one embodiment of the present invention.
Figure 6:
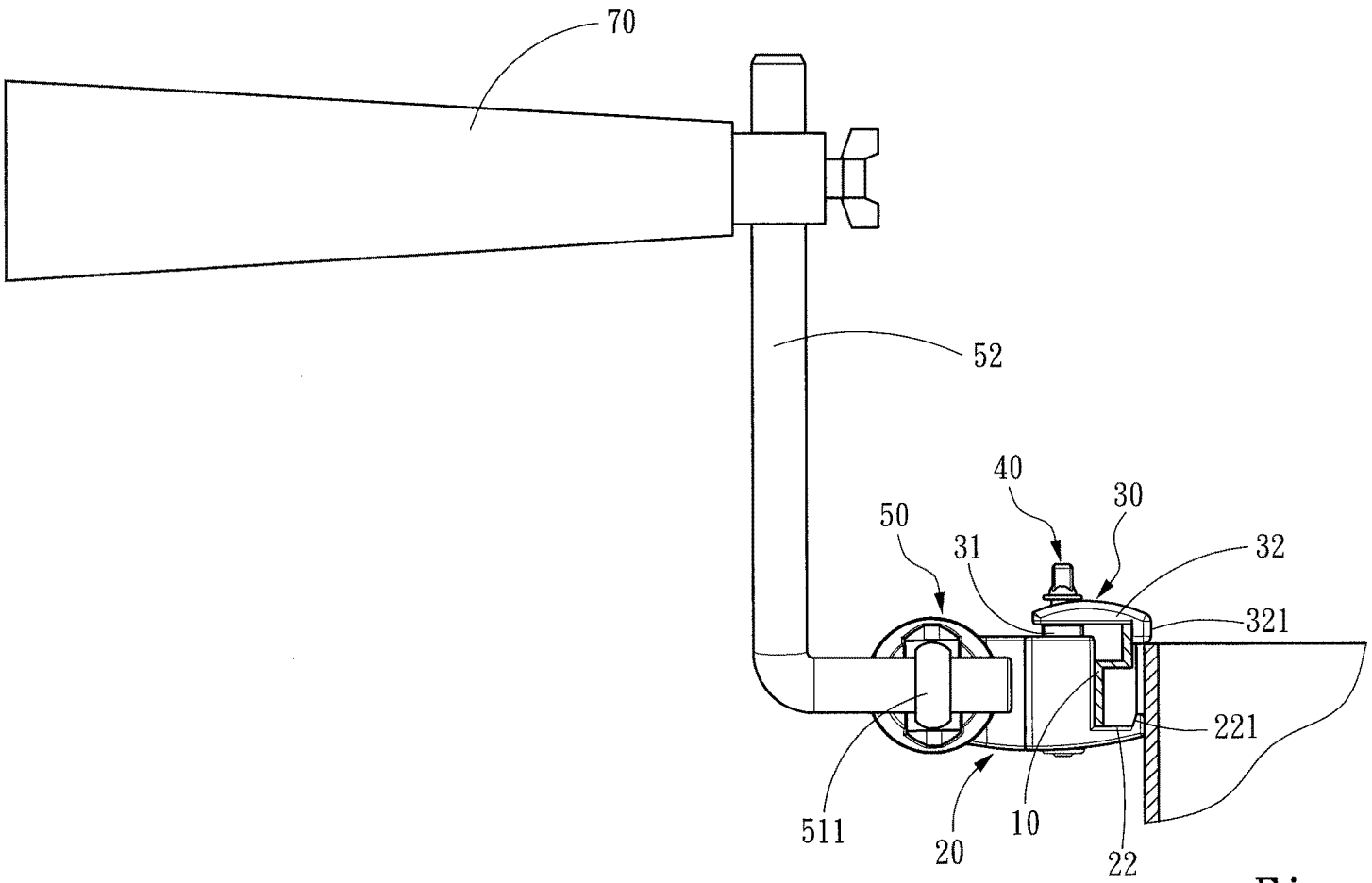
FIG. 6 is a diagram schematically showing an application of a drum counterhoop clamping device according to another embodiment of the present invention.

Refer to FIG. 5 and FIG. 6. In one embodiment, the base 20 includes a musical instrument clamp 50 disposed at one side far away from the first clamping plate 22. A connection element 51 is insertedly installed in the musical instrument clamp 50 and sleeves a vertical pole 52. Various musical instruments can be installed in the vertical pole 52, such as a cymbal 60 (shown in FIG. 5), a cowbell 70 (shown in FIG. 6), a woodblock, and a microphone supporter.

As shown in FIG. 4, the musical instrument clamp 50 includes a first body 501, a second body 502 which is assembled with the first body 501 to form a housing space and a elastic element 503 disposed in the housing space. The first body 501 includes a plurality of first ratchet teeth 504 and the second body 502 includes a plurality of second ratchet teeth 505. The connection element 51 includes a ring portion 511 and a shaft portion 512 which is connected to the ring portion 511 and run through the first body 501, second body 502 and the elastic element 502. The shaft portion 512 runs through the musical instrument clamp 50 and is coupled with a locking element 90. Moreover, the plurality of first ratchet teeth 504 and the plurality of second ratchet teeth 505 are in mesh after the first body 501 and the second body 502 are tightly coupled by screwing the locking element 90. In one embodiment, the locking element 90 is a screw nut.

Figure 7:
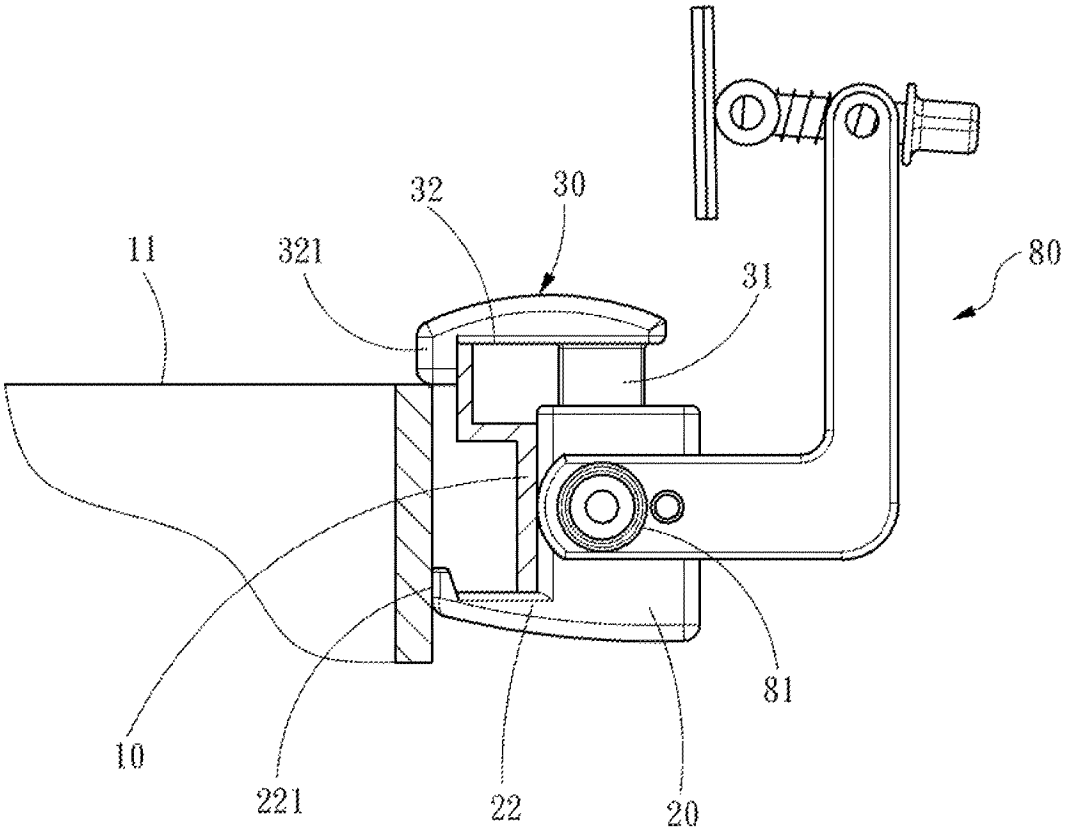
FIG. 7 is a diagram schematically showing an application of a drum counterhoop clamping device according to a further embodiment of the present invention.
Figure 8:
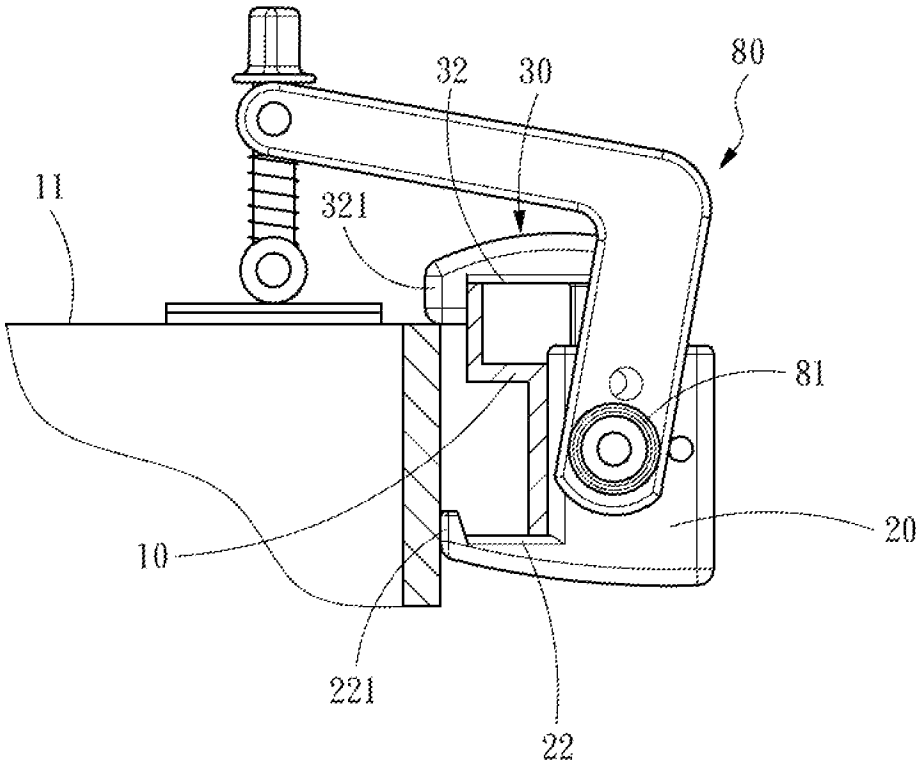
FIG. 8 is another diagram schematically showing the application of the drum counterhoop clamping device in FIG. 7.

Refer to FIG. 7 and FIG. 8. In one embodiment, a sordino 80 is pivotally coupled to the base 20. The sordino 80 can be rotated to contact a drumhead 11 for attenuating drum sounds, as shown in FIG. 8. In one embodiment, an actuation spring 81 is disposed between the base 20 and the sordino 80, separating the sordino 80 from the drumhead 11, whereby the drum can generate normal drum sounds, as shown in FIG. 7.

In the present invention, the locking member is rotated to narrow the gap between the first clamping plate and the second plating. As the first clamping plate and the second clamping plate are displaced relatively in a horizontal direction, side force would not appear. Without interference of side force, the first clamping plate and the second clamping plate can grip two sides of the drum counterhoop stably. Therefore, the present invention can clamp a drum counterhoop stably with high strength and satisfy requirement of users.

What is claimed is:

1. A drum counterhoop clamping device, which is to be fixed to a drum counterhoop, comprising a base including a sliding chute, a first clamping plate extending outward and vertically to the sliding chute and a musical instrument clamp disposed at one side far away from the first clamping plate, the musical instrument clamp including a first body, a second body which is assembled with the first body to form a housing space and an elastic element disposed in the housing space, wherein the first body includes a plurality of first ratchet teeth and the second body includes a plurality of second ratchet teeth;

a clamping block including a sliding post slidably installed inside the sliding chute and a second clamping plate extending outward and vertically to the sliding post;

a locking member driving the base and the clamping block to approach to each other and enforcing the sliding post to pass through the sliding chute to decrease the distance between the first clamping plate and the second clamping plate; and a connection element including a ring portion and a shaft portion which is connected to the ring portion and runs through the first body, second body and the elastic element, wherein the shaft portion runs through the musical instrument clamp and is coupled with a locking element, wherein the plurality of first ratchet teeth and the plurality of second ratchet teeth are in mesh after the first body and the second body are tightly coupled by screwing the locking element.

2. The drum counterhoop clamping device according to claim 1, wherein a first flange and a second flange are respectively extended from the first clamping plate and the second clamping plate.

3. The drum counterhoop clamping device according to claim 1, wherein the locking member includes a screw and a nut, which can be screwed together, and wherein the screw includes a screw head and a screw body, and wherein the screw body is passed through the sliding post with the screw head pressed against the sliding post, and wherein the nut is pressed against the sliding chute.

4. The drum counterhoop clamping device according to claim 3, wherein the clamping block includes a recess for accommodating the screw head.

5. The drum counterhoop clamping device according to claim 3, wherein the base includes an embedding cavity for accommodating the nut and restraining rotation of the nut.

6. The drum counterhoop clamping device according to claim 1, wherein the ring portion sleeves a vertical pole.

7. The drum counterhoop clamping device according to claim 1, wherein a sordino is pivotally coupled to the base.

8. The drum counterhoop clamping device according to claim 7, wherein an actuation spring is disposed between the base and the sordino, driving the sordino to rotate.

* * * * *